US006231205B1

(12) United States Patent
Slesinger et al.

(10) Patent No.: US 6,231,205 B1
(45) Date of Patent: May 15, 2001

(54) ILLUMINATED SHELVING

(75) Inventors: Bruce M. Slesinger; Thomas L. Collom, both of San Francisco, CA (US)

(73) Assignee: Powerwall, Inc., San Francisco, CA (US)

( * ) Notice: Subject to any disclaimer, the term of this patent is extended or adjusted under 35 U.S.C. 154(b) by 0 days.

(21) Appl. No.: 09/177,918

(22) Filed: Oct. 23, 1998

(51) Int. Cl.[7] ..... F21V 33/00

(52) U.S. Cl. ..... 362/133; 362/127; 362/217; 362/219; 362/223; 362/225; 362/125; 439/110; 439/121; 439/527; 439/529; 439/530

(58) Field of Search ..... 362/33, 127, 133, 362/217, 219, 221, 222, 223, 224, 225, 125; 312/223.5, 223.6, 223.1; 439/110, 113, 114, 892, 893, 527, 529, 530, 115, 116, 117, 121, 119

(56) References Cited

U.S. PATENT DOCUMENTS

| | | | | |
|---|---|---|---|---|
| D. 350,834 | | 9/1994 | Roos et al. | D26/134 |
| D. 355,501 | | 2/1995 | Roos et al. | D26/63 |
| D. 362,656 | | 9/1995 | Roos et al. | D13/134 |
| D. 376,026 | | 11/1996 | Wachter | D26/63 |
| D. 394,241 | | 5/1998 | Wachter et al. | D13/110 |
| 4,689,726 | * | 8/1987 | Kretzschmar | 362/127 |
| 4,845,601 | * | 7/1989 | Podbury et al. | 439/110 |
| 4,908,743 | * | 3/1990 | Miller | 439/110 |
| 4,972,339 | | 11/1990 | Gabrius | 362/366 |
| 5,034,861 | | 7/1991 | Sklenak et al. | 362/92 |
| 5,259,774 | | 11/1993 | Gabrius | 439/110 |
| 5,334,037 | | 8/1994 | Gabrius et al. | 439/118 |
| 5,336,100 | | 8/1994 | Gabrius et al. | 439/115 |
| 5,510,965 | * | 4/1996 | Teakell | 362/223 |
| 5,564,815 | | 10/1996 | Littman et al. | 362/147 |
| 5,690,415 | * | 11/1997 | Krehl | 362/133 |
| 5,788,518 | | 8/1998 | Wachter et al. | 439/121 |

FOREIGN PATENT DOCUMENTS

| | | | | |
|---|---|---|---|---|
| 38 09 859C1 | | 3/1989 | (DE) | A47F/11/10 |
| 000609170A1 | * | 8/1994 | (EP) | 362/224 |
| 2 731 885A1 | | 9/1996 | (FR) | A47B/47/00 |
| 2 272 279 | | 5/1994 | (GB) | F21V/33/00 |

* cited by examiner

*Primary Examiner*—Cassandra Spyrou
*Assistant Examiner*—John Juba, Jr.
(74) *Attorney, Agent, or Firm*—Fish & Neave; Kevin P. B. Johnson; Michael J. DeHaemer, Jr.

(57) ABSTRACT

A display case is provided having vertical members with internal conductors. The conductors are coupled to a source of low voltage electrical power such that adjacent vertical members are of differing electrical polarity. Shelf supports are designed to make electrical contact with the internal conductors when engaged in a vertical member. A light fixture, disposed on the underside of a shelf is electrically coupled to the shelf supports thereby completing an electrical circuit for energizing the light fixture.

20 Claims, 8 Drawing Sheets

ILLUMINATED SHELVING

BACKGROUND OF THE INVENTION

The present invention relates generally to methods and apparatus for the display of items in a residential, office, commercial, or retail environment, and more particularly to a display system including shelves having a low voltage light fixture mounted underneath.

In a retail environment it is common for merchandise to be displayed on a system of adjustable shelves. For example a display case may resemble a bookcase. This type of display case typically has a number of holes bored into opposing sides of the case. Pegs inserted into the holes support shelves for displaying items, such as merchandise or objet d'art. Such displays may be easily rearranged by relocating the pegs to different sets of holes in the sides of the display case.

Alternatively, the system of adjustable shelves may comprise a wall display. Typically, a number of vertically-oriented, slotted standards are attached to a wall. Brackets having hooks designed to engage the slots on the standards support the shelves. Such displays may be easily rearranged by relocating the brackets to different slots in the vertically oriented standards.

To attract customers it is important that a merchandise display be aesthetically pleasing so as to present the merchandise to a potential customer in a highly visible and attractive manner. In many retail establishments, the major source of lighting is wide area illumination provided by ceiling mounted light fixtures, supplemented with spot lighting to accent and highlight specific areas or merchandise. When non-illuminated shelving is used, shelves nearer the ceiling cast shadows onto lower shelves which results in less than optimal lighting of merchandise displayed on the lower shelves. It is therefore desirable to provide a means of illuminating merchandise on lower shelving or racks of a display.

Prior art attempts to provide illuminated display systems have been less than satisfactory either because they are aesthetically displeasing or are cumbersome and inflexible. Early attempts at providing illuminated shelving were essentially ordinary light fixtures mounted to the underside of a display shelf. A conventional power cord was then run from the light fixture to an outlet. Preferably, the cord was strung under shelving, behind merchandise on display, or otherwise hidden from a customer's view so that it would not detract from an otherwise pleasing display. For a system of fixed shelving, or shelving with a limited range of adjustment, the power cord may be hidden from view fairly successfully. However, when using vertically adjustable shelving, the power cord would typically droop or otherwise be exposed to view.

Previous systems have attempted to alleviate some of these difficulties by providing an outlet or power source that may be moved within a limited range so that it is located adjacent to a shelf containing a light fixture. For example, U.S. Pat. No. 5,022,720 discloses a bakery display case that provides vertically adjustable shelves having a light fixture mounted on the front. A plurality of electrical outlets are slidably mounted in a channel at the rear of the display area. The outlets may be relocated vertically within a limited range so that an outlet is juxtaposed adjacent to each shelf, to help minimize power cord exposure.

Alternatively, U.S. Pat. Nos. 4,973,796 and 5,425,648, disclose vertical shelf standards including internal conductors. The conductors are housed within the standards in such a way that an ordinary shelf bracket would not contact the conductors. Specially designed couplers include spring wires or clips that contact the internal conductors when the coupler is inserted into the shelf standard. In a display unit according to either of these patents, an illuminated shelf may be inserted into and supported by a pair of shelf standards and a special electrical coupler cabled to a light fixture may be inserted into one of the shelf standards just below the shelf itself to help minimize cable exposure.

While the aforementioned patents solve the problem of providing power to shelf light fixtures, they involve the use of shelf standards and connectors that are electrically and mechanically complex and are therefore more costly to manufacture than conventional shelf standards, and are more susceptible to failure due to mechanical fatigue and wear. Furthermore, electrical connections to the internal conductors of the shelf standards are made by a separate, specially designed connector located adjacent to, but not integral with, a supporting bracket for an illuminated shelf, so the power cord is not entirely hidden from view.

In view of the foregoing, it would be desirable to provide a system of illuminated shelving wherein electrical connections for energizing the illuminated shelves do not detract from the aesthetic appeal of the system.

It would also be desirable to provide a system of illuminated shelving wherein the components thereof are electrically and mechanically simple in design and therefore relatively inexpensive to manufacture.

SUMMARY OF THE INVENTION

It is therefore an object of the invention to provide a system of illuminated shelving wherein electrical connections for energizing the illuminated shelves do not detract from the aesthetic appeal of the system.

It is also an object of the invention to provide a system of illuminated shelving wherein the components thereof are electrically and mechanically simple in design and therefore relatively inexpensive to manufacture.

These and other objects and advantages of the present invention are realized by providing a modular, low-voltage, low-profile light fixture mounted to a bottom surface of a shelf. The light fixture includes an extruded base having a light track, or channel, for accepting track light style lamp holders. The base may be cut to length to fit the shelving in a display system. End caps, adapted to couple a conductive shelf support to buses in the channel, are attached to each end of the base. If desired, an extruded lens may be attached to the base and cover the lamp holders. The shelf supports, which may include pins or brackets and the like, are inserted and receive power from conductors in the side of a display case or internal to the vertically-oriented standards.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION

Figure 1:
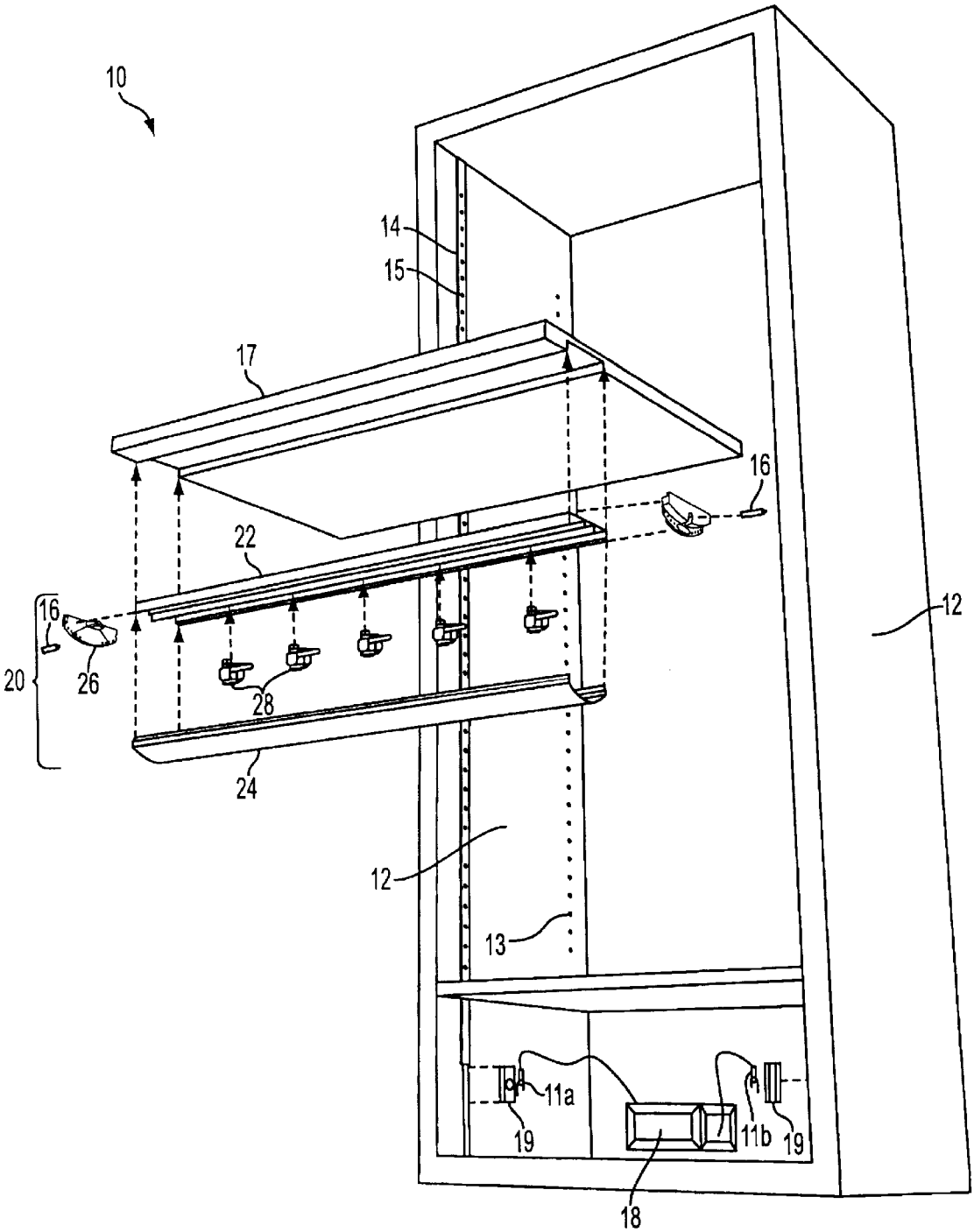
FIG. 1 is an exploded perspective view of an illustrative display case constructed in accordance with the principles of the present invention.

Referring first to FIG. 1, a first illustrative embodiment of the present invention is shown by way of display case 10, which may be either free standing or attached to a supporting wall. Sides 12 include power strips 14 mounted into a groove or slot therein. Sides 12 also include a number of spaced apart holes 13 for accepting conventional shelf support pins. Power strips 14 includes a number of spaced apart holes 15 corresponding to holes 13. Together, holes 13 and 15 accept steel pins 16 to support shelf 17 which may contain under-shelf light fixture 20. It should be understood the perspective used in FIG. 1 hides one power strip from view, and that both sides of display case 10 include holes 13 and power strip 14.

Power for the display case is provided by low voltage power supply 18, which converts line voltage to a low voltage of about 12 volts, bu may be as high as about 24 volts depending on the number of lighted shelves installed in display case 10. A suitable power supply is available from Translite Systems, of San Carlos, Calif. Low voltage power supply 18 is coupled to power strips 14 by connector blocks 19. Preferably, low voltage power supply 18 is hidden within the base of display case 10.

Figure 2:
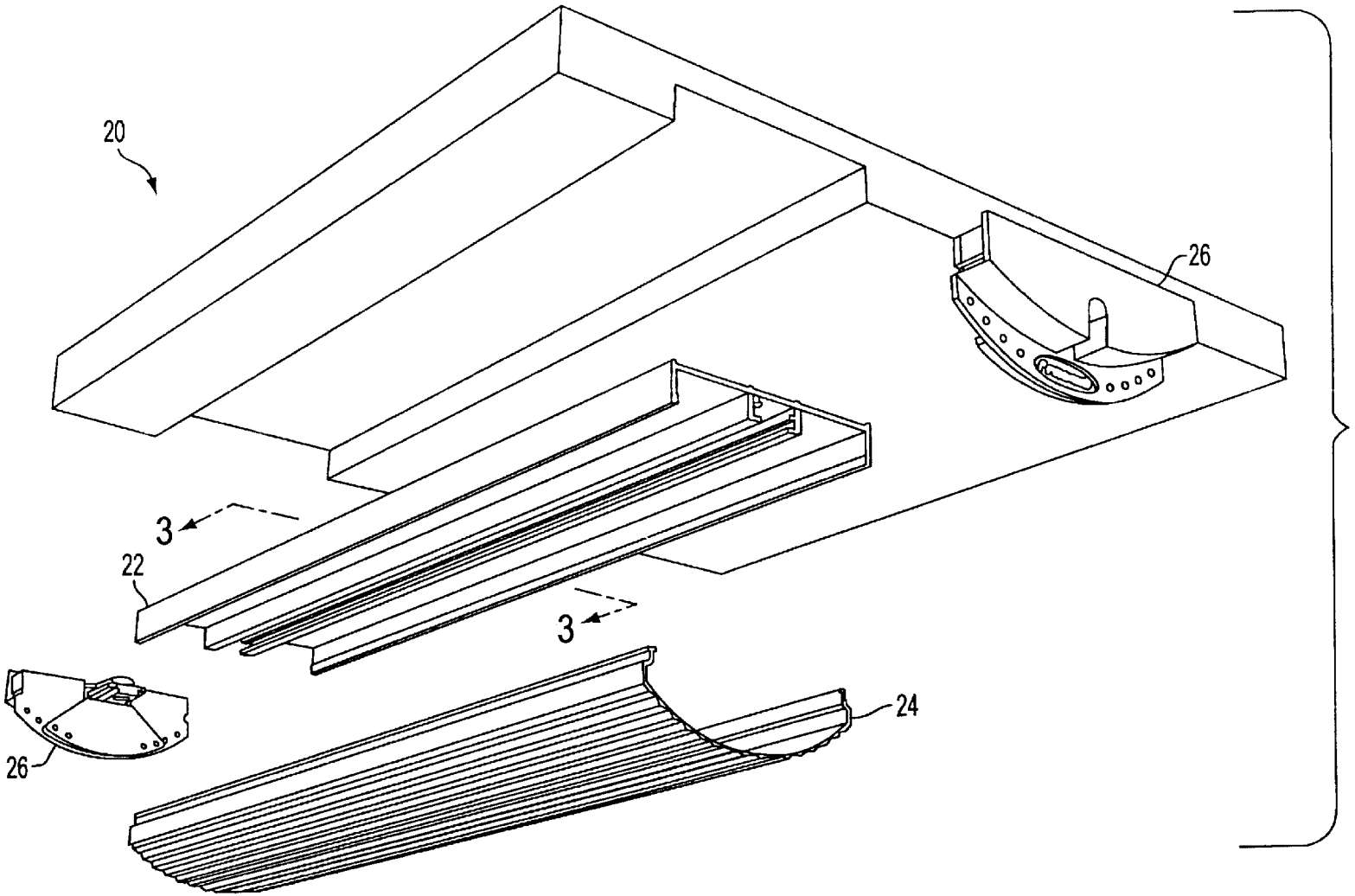
FIG. 2 is an exploded perspective providing a more detailed view of an illustrative embodiment of the lighted shelf of FIG. 1.
Figure 3:
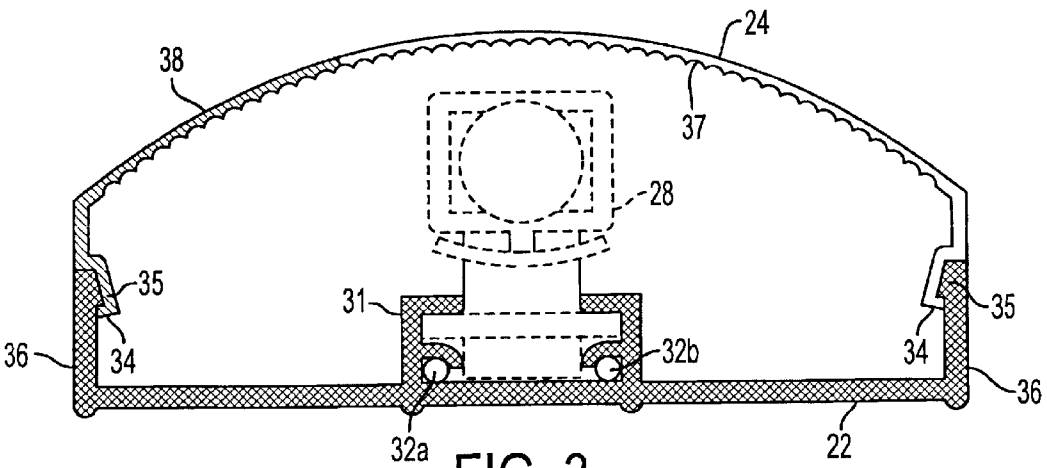
FIG. 3 is a cross sectional view of a base and lens of the light fixture of FIG. 2.
Figure 7A:
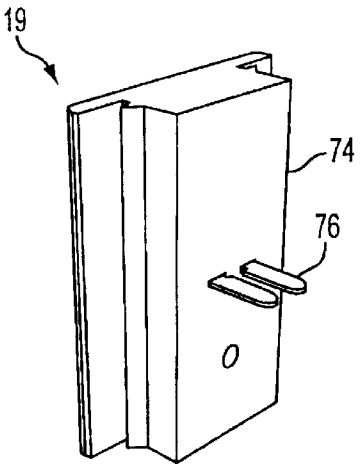
FIGS. 7A and 7B are, respectively, front and rear perspective views of an exemplary coupling block for use with the electrified support of FIGS. 6A and 6B.
Figure 7B:
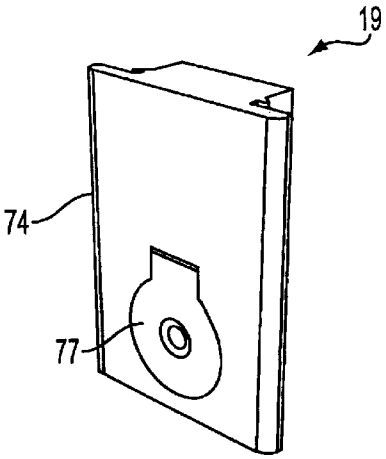

Light fixture 20, which is shown in more detail in FIGS. 2–5, includes base 22, lens 24, end caps 26, and lamp holders 28. Base 22 is mounted to the bottom surface of shelf 17, and is preferably let into a groove or dado therein, and is attached to shelf 17 by means of mechanical fasteners or a suitable adhesive. Base 22 comprises an extrusion of ABS plastic having a cross section as shown in FIG. 3. To minimize cost, base 22 is preferably a single extrusion, but bas 22 may be built up from multiple components, such as a track fastened to a wide 'U'-shaped channel. Base 22 may also be made of polycarbonate, PVC, or other suitably rigid plastic. Alternatively, all or some of base 22 may be made of metal, such as extruded aluminum, in which case insulation must be provided between base 22 and buses 32*a* and 32*b*.

Light track 31 is preferably adapted to engage a suitable track light lamp holder equipped with halogen or xenon lamps. A low profile lamp holder such as that depicted in U.S. Pat. No. Des. 362,656 is one example of a lamp holder suitable for use with base 22. The interior of base 22 may be made reflective, such as by the addition of a reflective foil or coating, to help reflect heat and light from the bulbs in lamp holder 28.

Lens 24 is preferably a transparent polycarbonate extrusion designed to distribute the light provided by lamps 28. To that end, lens 24 may be smooth, textured, or faceted, and may be transparent, translucent, or partially opaque, depending on the specific lighting needs. For example, lens 24 may include longitudinal grooves 37 for focusing the light downward, and may include opaque portion 38 to reduce the amount of horizontally projected light. Lens 24, includes lip 34 for mating with corresponding shoulder 35 of base 22.

Figure 4A:
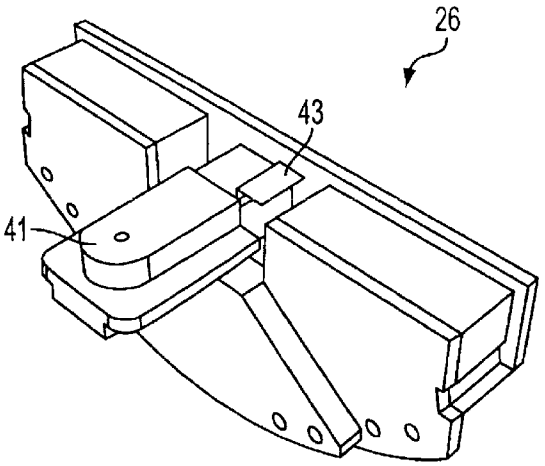
FIGS. 4A and 4B are respectively, front and rear perspective views of an assembled end cap of FIG. 2.
Figure 4B:
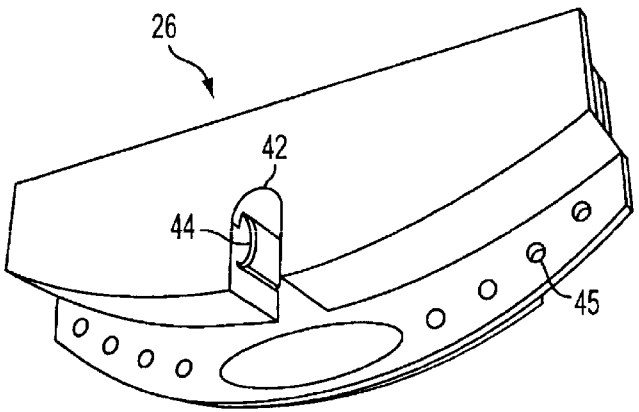

Referring now to FIGS. 4A and 4B, an illustrative embodiment of end cap 26 is described in accordance with the principles of the present invention. End cap 26 includes end cap conductor 40, tongue 41, and notch 42. Tongue 41 is designed to engage or slide into an end of track portion 31 of base 22 as depicted in FIG. 2. Conductor 40 includes tab 43 which comes into contact with one of conductors 32 when tongue 41 is engaged with light track 31. Notch 42 is designed to fit over pin 16 inserted into hole 15 in power strip 14 of FIG. 1. Conductor 40 also includes spring portion 44 disposed in notch 42 to provide for positive electrical contact between pin 16 and conductor 40. Preferably end cap 26 is injection molded from a suitable thermoplastic, such as Noryl, although PBT or a ABS/polycarbonate blend may also be used.

Figure 5:
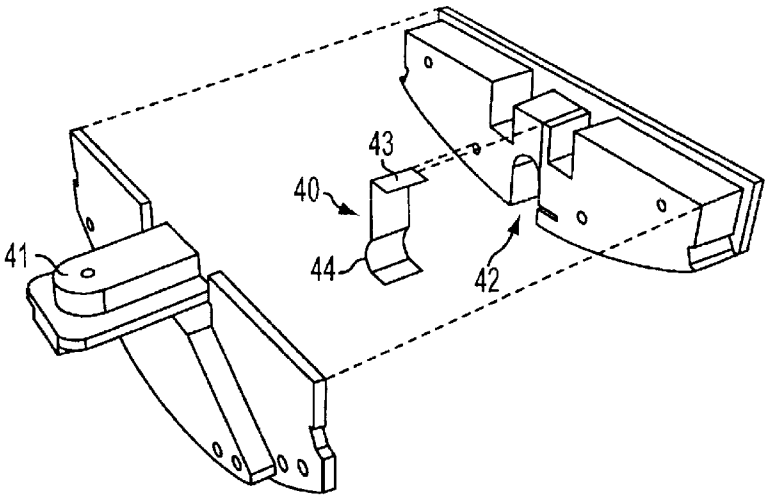
FIG. 5 is a detailed exploded view, in perspective, of an end cap of the light fixture of FIG. 4A and 4B.

Preferably, end cap 26 is symmetrical with respect to the centerline of tongue 41, so that a single end cap design may be used for either end of lighting fixture 20. Alternatively, different end caps may be used at either end; however, it is important that each one of conductors 32 is coupled to a separate end cap FIG. 5 is an exploded perspective view of an illustrative method for constructing end cap 26 in accordance with the principles of the present invention.

Figure 6A:
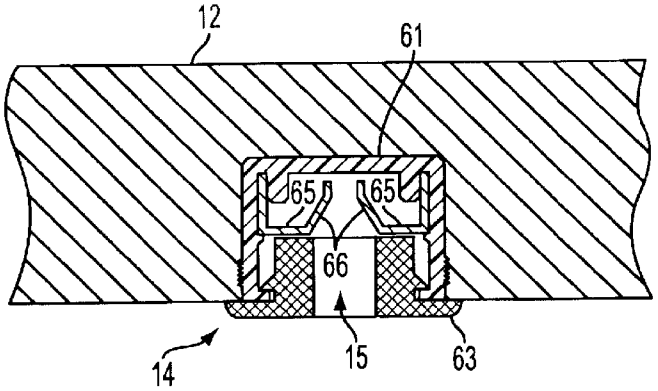
FIGS. 6A and 6B are, respectively, a cross section and elevation of the electrified support of the display case of FIG. 1.
Figure 6B:
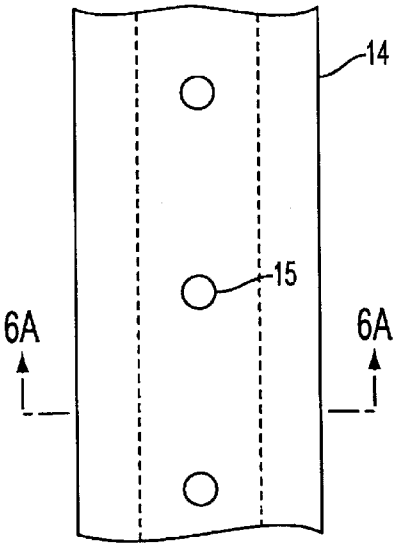

Power strip 14, shown in more detail in FIGS. 6A and 6B, is mounted in a vertical groove milled in side 12 of display case 10, and provides a means of bringing electrical power to shelf 17. Power strip 14 includes rear housing 61, front housing 63, both made of extruded PVC vinyl or an ABS/polycarbonate material, and conductor 65. Front housing includes holes 15 sized to accept pin 16 of FIG. 1. Conductor 65, which may comprise two strips of a conductive material, such as brass or copper, or a single piece having suitable openings along its length, includes one or more tangs 66. Rear housing 61 has a number of slots, grooves, or ridges which hold conductor 65 in place, such that tangs 66 are juxtaposed behind holes 15 in power strip 14. When pin 16 is inserted into hole 15, tangs 66 are deflected by pin 16 thus ensuring good electrical contact. For ease of assembly, rear housing 61 and front housing 63 are preferably designed to snap together.

Connector 19 has a cross section similar to that of front housing 63, so that it may be snapped into rear housing 61 near the bottom of display case 10 of FIG. 1. A through conductor embedded in connector body 74 includes one or more prongs 76 and head 77. When snapped into rear housing 61, prongs 76 provide electrical contact with conductors 65 within rear housing 61. Wire 11 from power supply 18 (see FIG. 1) is coupled to head 76 by a screw, bolt, or other suitable device.

It will be apparent from the foregoing description and drawings that the various assemblies described cooperate to provide power from power supply 18 to lamps 28 in lighting fixture 20. Specifically, electrical current may flow from power supply 18 through wire 11 and connector 19 to conductors 65 inside power strip 14. Pin 16, inserted into hole 15 in power strip 14, contacts tangs 66 of conductor 65, thereby establishing electrical contact. Notch 42 in end cap 26 accepts a portion of pin 16 protruding from power strip 14 such that spring portion 44 of end cap conductor 40 makes electrical contact with pin 16. Tab 43 of end cap conductor 40 makes electrical contact with bus 32, which in turn is electrically coupled to lamp holder 28. Thus, current flows through conductor 65, pin 16, end cap conductor 40, and light track bus 32 to lamp holder 28. Current then returns via a similar path through the other bus, end cap, pin, conductor, connector, and wire to power supply 18, thereby completing an electrical circuit, and providing electrical energy for illuminating lamps 28.

Figure 8:
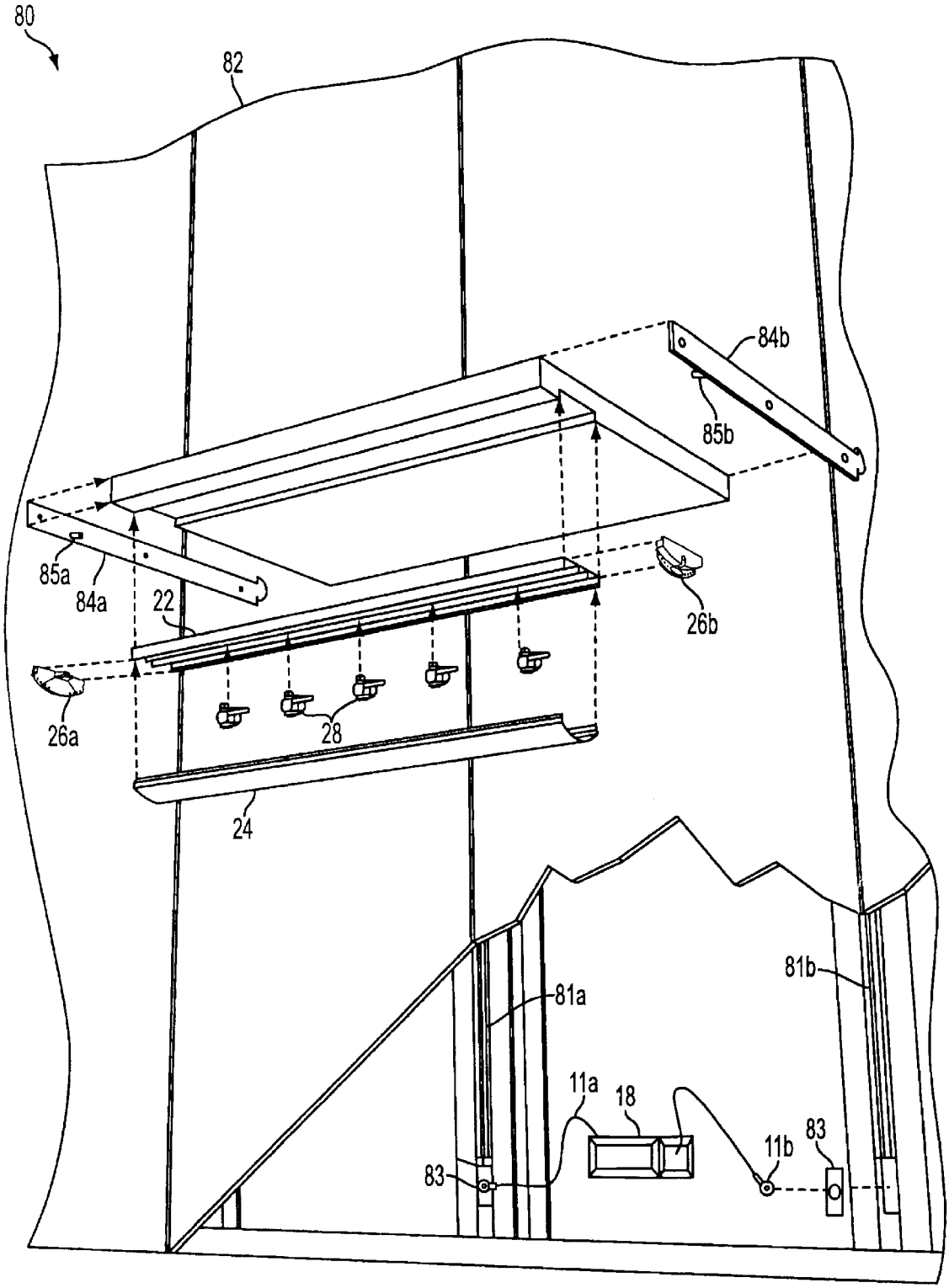
FIG. 8 is an alternative embodiment of an illustrative display system in accordance with the principles of the present invention.

The illustrative embodiment of a display case of the present invention described above is suitable for many types of merchandise displays. However, for reasons of size, flexibility, or aesthetics, display case 10 may not be desirable. An exemplary wall unit including a lighted shelf in accordance with the principles of the present invention is shown in FIG. 8.

Wall unit 80 includes slotted standards 81 spaced at intervals along and fastened to a wall or other suitable structure. Power supply 18 is coupled to standards 81 by means of wires 11 and connectors 83. If desired, standards 81 and power supply 18 may be hidden behind panels 82. Gaps between panels 82 provide access to standards 81.

Figure 9A:
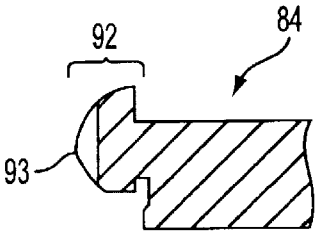
FIGS. 9A and 9B show shank portions of support brackets for use with the display system of FIG. 8.
Figure 9B:
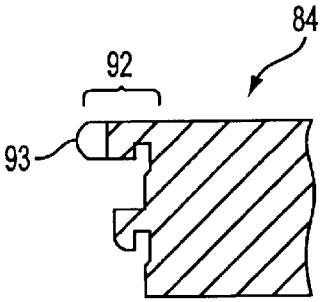

Shelf 17 is the same as described above in connection with FIGS. 2–5 with the addition of brackets 84 on either side. Brackets 84 include shank portion 92, as shown in FIGS. 9A and 9B and a cantilever portion which is attached to shelf 17 by screws or other suitable fasteners. Pin 85 protrudes from a side of the cantilever portion of bracket 84 and engages notches 42 in end caps 26 to provide an electrical connection between bracket 84 and end cap conductor 40. Preferably, brackets 84 are powder coated, except for pin 85 and contact area 93 on shank portion 92.

Figure 10A:
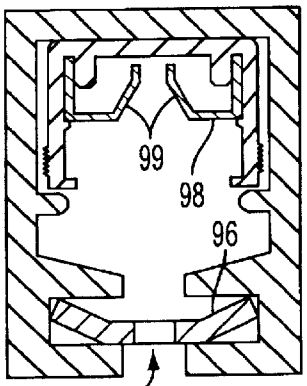
FIGS. 10A and 10B are, respectively, a cross section and elevation of the standard of FIG. 8.
Figure 10B:
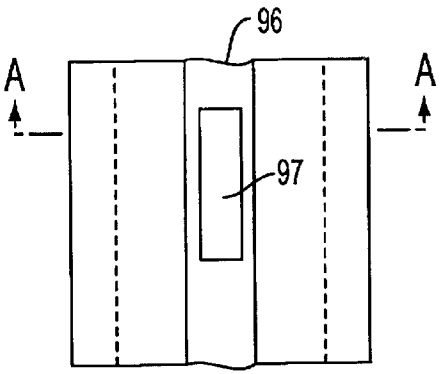

Referring now to FIGS. 10A and 10B, standards 81 include slotted member 96 having a number of slots 97 spaced along its length adapted to accept shank portion 92 of bracket 84 and support bracket 84 in a cantilevered fashion. Standard 81 also includes conductors 98 disposed behind slotted member 96. Conductors 98 include tangs, or tabs, 99 juxtaposed behind slots 97 so that when shank portion 92 of bracket 84 is engaged with slot 97, contact area 93 makes electrical contact with tabs 99. Preferably, standard 81 is adapted to accept a rear housing as used in power strip 14 of FIGS. 6A and 6B, thereby simplifying manufacture.

Thus, it will be understood that standards 81, brackets 84, and light fixture 20 cooperate to complete an electrical circuit between power supply 18 and one or more lamps in light fixture 20. Specifically, the circuit comprises power supply 18, wire 11*a*, standard 81 a with internal conductors 98, bracket 84*a* with pin 85*a*, end cap 26*a*, and bus 32*a* (FIG. 3), and returning via bus 32*b*, end cap 26*b*, bracket 84*b* with pin 85*b*, standard 81*b*, and wire 11*b*.

Figure 11:
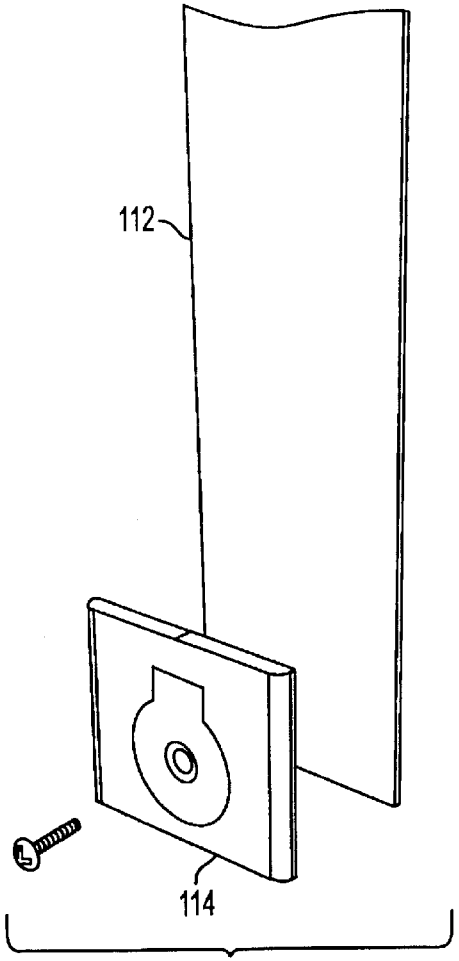
FIG. 11 is a perspective view of a conductive tape and connector for retrofitting a lighted shelf ito a non-powered display case.
Figure 12A:
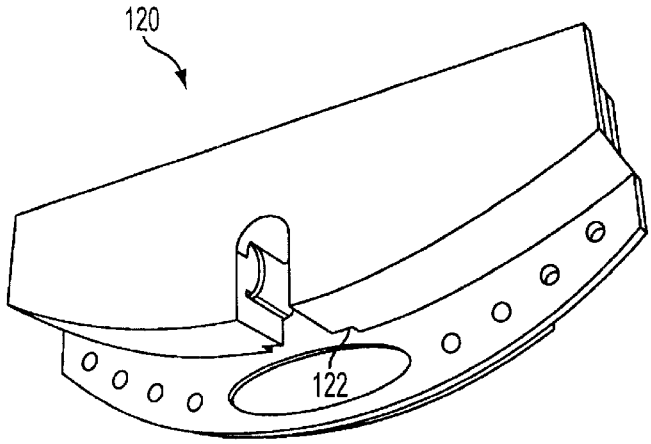
FIGS. 12A and 12B are, respectively, a perspective and an exploded view of an end cap for use in a retrofitted display case.
Figure 12B:
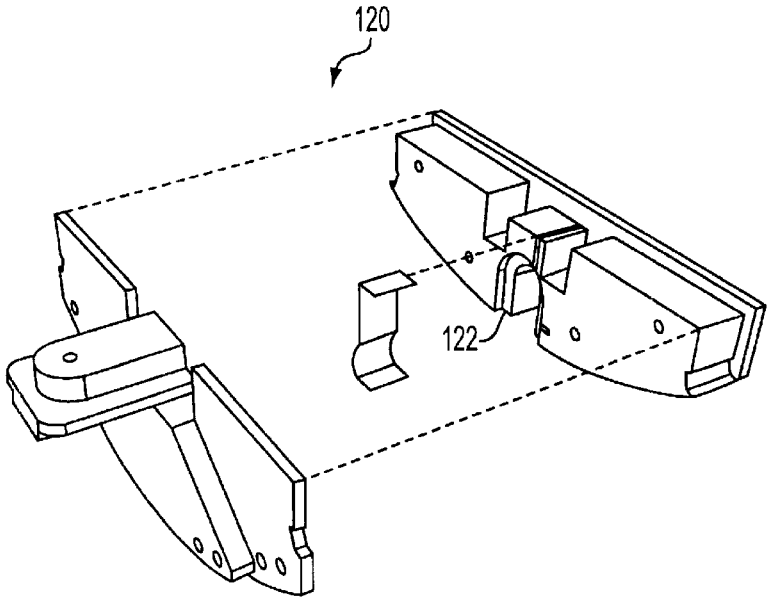

The illustrative embodiments described thus far are suitable for use in new installations, or in connection with a major remodeling, or overhaul, of an existing display. An embodiment of the invention for use in retrofitting an existing display is now described in connection with FIGS. 11–13. Retrofitting an existing display case would require a fairly extensive amount of work to create a groove in the side of the display case and install a power strip, such as that in FIGS. 6A and 6B. As an alternative, conductive tape 112, such as that shown in FIG. 11 may be adhered to the inside of surface of the display case sides. Connector 114 provides a means of attaching a power supply to conductive tape 112.

Figure 13:
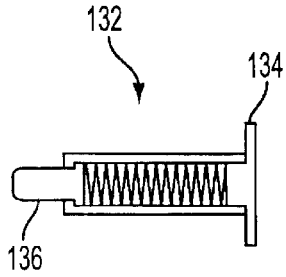
FIG. 13 a cross section of a plunger for use with the end cap of FIGS. 12A and 12B.

A retrofit system also uses a slightly modified end cap. End cap 120, is identical to the end cap of FIGS. 4 and 5, except that end cap 120 includes groove 122 adjacent to notch 124. Spring loaded pin 132, shown in FIG. 13, is inserted into notch 124 so that saddle 134 fits into groove 122. The retrofit shelf is put in the display case so that plunger 136 of spring loaded pin 132 contacts one of conductive tapes 112. A circuit is thus completed through conductive tapes 112, spring loaded pins 132, and the light fixture.

Figure 14A:
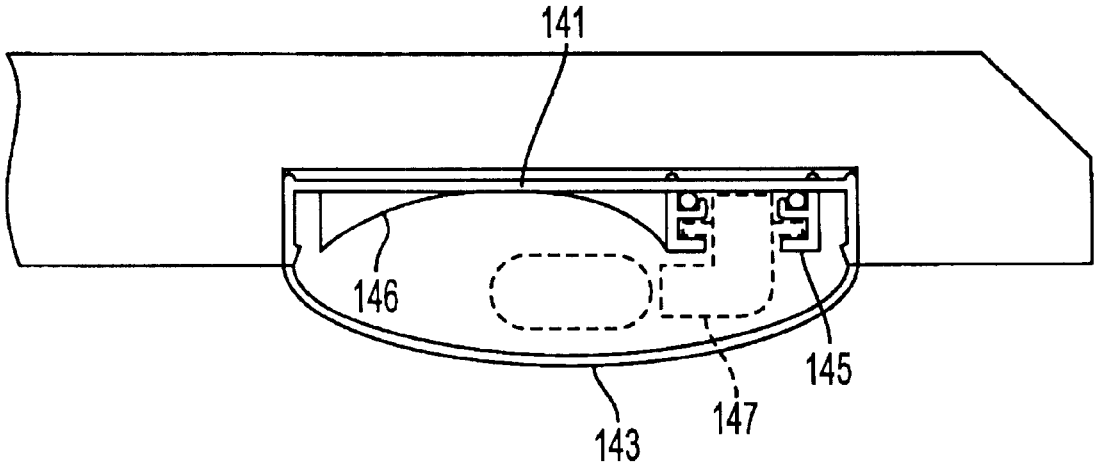
FIGS. 14A and 14B are cross sections of showing alternative configurations of a light fixture constructed in accordance with the principles of the present invention.
Figure 14B:
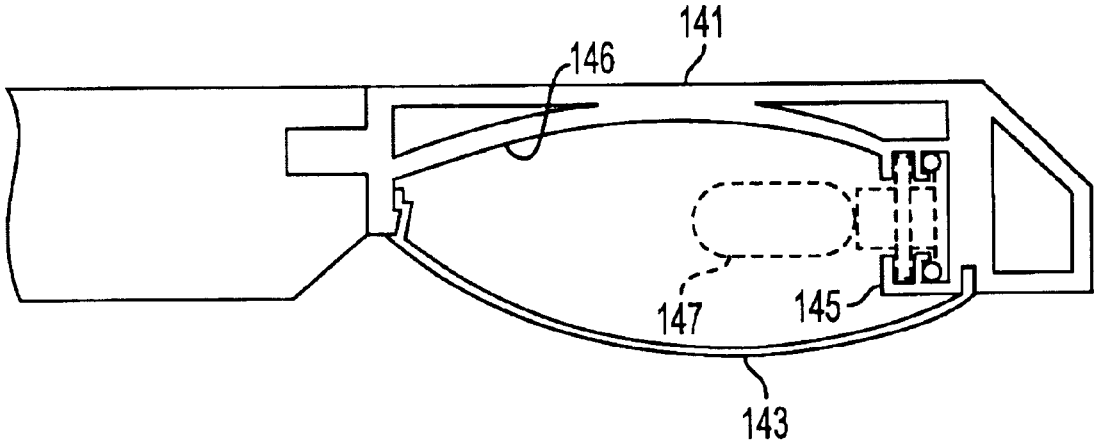

FIGS. 14A and 14B show alternative embodiments of an under shelf light fixture in accordance with the principles of the present invention. As in the other embodiments shown herein, the light fixture includes base 141, lens 143, and end caps (not shown). These embodiments show light track 145 at different positions on base 141. Base 141 also includes a portion 146 having parabolic shape for focusing light from lamps 147 as may be desired. One skilled in the art will understand that the light fixtures of FIGS. 14A and 14B utilize distinct left and right end caps, in contrast to the previous embodiments, which utilize a single reversible end cap.

While a preferred embodiment of the present invention has been described herein, it will be apparent to one skilled in the art that various changes and modifications may be made therein without departing from the spirit and scope of the invention. For example, combining structural elements, substituting materials, modifying shapes of components, and interchanging prongs and sockets are exemplary modifications which would not fall outside the scope of the present invention.

Therefore, it is intended that the appended claims cover all such changes and modifications which fall within the true spirit and scope of the invention.

We claim:

1. A light fixture, for a shelf disposed from a plurality of supports, the light fixture comprising:

a base, including a light track disposed along a length of the base, the light track including first and second electrical buses;

a lens coupled to the base;

a first end cap disposed from a first end of the base, the first end cap including:

a body having a first portion for engaging the light track and a second portion for engaging one of the plurality of supports, and a conductor adapted to electrically couple a support engaged by the end cap to the first electrical bus.

2. The light fixture of claim 1 further comprising a second end cap disposed from a second end of the base the second end cap including:

a body having a first portion for engaging the light track and a second portion for engaging one of the plurality of supports, and a conductor adapted to electrically couple a support engaged by the end cap to the second electrical bus.

3. The light fixture of claim 2 wherein the first and second end caps are substantially identical.

4. The light fixture of claim 1 wherein the base and light track comprise a single extruded structure.

5. The light fixture of claim 2 wherein the first and second end caps are symmetrical.

6. The light fixture of claim 2 wherein the first portion of the first and second end caps comprises a protrusion adapted to engage the light track.

7. The light fixture of claim 2 wherein the second portion comprises a notch adapted to engage a pin.

8. The light fixture of claim 2, wherein the first and second end caps comprise:

a molded plastic body wherein the first portions of the first and second end caps comprise a protrusion adapted to engage the light track and the second portions comprises a notch adapted to engage a pin.

9. The light fixture of claim 8 wherein the conductor of each end cap comprises a metallic strip disposed in the body such that the metallic strip is adjacent to both the protrusion and the notch.

10. The light fixture of claim 1 wherein the light track and base comprise multiple pieces coupled together.

11. The light fixture of claim 1 wherein the base is adapted to be mounted to a bottom surface of a shelf, so that the light fixture may illuminate a region below the shelf.

12. The light fixture of claim 1, wherein the light track comprises a channel; and the first and second electrical buses comprise first and second spaced apart conductors disposed within the channel.

13. The light fixture of claim 12 wherein the base further comprises at least one outwardly extending portion.

14. The light fixture of claim 13 wherein the at least one outwardly extending portion is adapted to receive a mating portion of the lens.

15. A method for illuminating a region under a shelf, wherein the shelf is supported by supporting members which may be electrically energized, the method comprising:

providing a light fixture disposed on a bottom surface of the shelf, the light fixture including a base having a light track, a lens coupled to the base, and a pair of end caps, wherein each end cap comprises:

a body having a first portion adapted to electrically and mechanically couple to a supporting member and a second portion adapted to electrically and mechanically couple to the light track; and a conductive portion disposed between the first and second portions so that the light track is electrically coupled to a supporting member when the shelf is supported by the supporting member.

16. The method of claim 15 wherein the supporting members comprise a plurality of pins and the first portion of each body has a notch for engaging one of the plurality of pins.

17. The method of claim 16 wherein each second portion of the body comprises a protruding portion that plugs into an end of the light track.

18. The method of claim 16 wherein the conductive portion comprises a metallic strip disposed in the body such that the metallic strip is adjacent to the first and second portions of the body.

19. The method of claim 18 wherein the metallic strip is shaped so that a portion protrudes into the notch and is biased against one of the plurality of pins when the pin is engaged in the notch.

20. The method of claim 15 wherein the conductive portion comprises a metallic strip disposed in the body such that the metallic strip is adjacent to the first and second portions of the body.

* * * * *

UNITED STATES PATENT AND TRADEMARK OFFICE

CERTIFICATE OF CORRECTION

PATENT NO. : 6,231,205 B1
DATED : May 15, 2001
INVENTOR(S) : Slesinger et al.

It is certified that error appears in the above-identified patent and that said Letters Patent is hereby corrected as shown below:

Title page,
Item [56], References Cited, U.S. PATENT DOCUMENTS, change "2 272 279" to -- 2 272 279A --

Column 3,
Line 47, change "bu" to -- but --

Signed and Sealed this

Seventeenth Day of December, 2002

JAMES E. ROGAN
*Director of the United States Patent and Trademark Office*